US008981644B2

(12) United States Patent
Neate et al.

(10) Patent No.: US 8,981,644 B2
(45) Date of Patent: Mar. 17, 2015

(54) LUCENT WAVEGUIDE ELECTROMAGNETIC WAVE PLASMA LIGHT SOURCE

(75) Inventors: Andrew Simon Neate, Buckinghamshire (GB); Barry Preston, Leicestershire (GB)

(73) Assignee: Ceravision Limited, Milton Keynes (GB)

( * ) Notice: Subject to any disclaimer, the term of this patent is extended or adjusted under 35 U.S.C. 154(b) by 45 days.

(21) Appl. No.: 13/996,570

(22) PCT Filed: Dec. 20, 2011

(86) PCT No.: PCT/GB2011/001744

§ 371 (c)(1), (2), (4) Date: Oct. 22, 2013

(87) PCT Pub. No.: WO2012/085506

PCT Pub. Date: Jun. 28, 2012

(65) Prior Publication Data

US 2014/0042901 A1 Feb. 13, 2014

(30) Foreign Application Priority Data

Dec. 21, 2010 (GB) ..... 1021811.3

(51) Int. Cl.
*H01J 65/04* (2006.01)

(52) U.S. Cl.
CPC ..... *H01J 65/044* (2013.01)
USPC ..... 313/573; 313/634

(58) Field of Classification Search
CPC ..... H01J 61/30; H01J 61/04
USPC ..... 313/573, 635, 634, 567; 315/246, 248
See application file for complete search history.

(56) References Cited

U.S. PATENT DOCUMENTS

| | | | |
|---|---|---|---|
| 2002/0011802 | A1 | 1/2002 | Espiau et al. |
| 2008/0203922 | A1 | 8/2008 | Guthrie et al. |

FOREIGN PATENT DOCUMENTS

| | | |
|---|---|---|
| EP | 2 188 829 | 5/2010 |
| WO | 2006002146 | 1/2006 |
| WO | 2009063205 | 5/2009 |
| WO | 2010055275 | 5/2010 |

*Primary Examiner* — Tracie Y Green
(74) *Attorney, Agent, or Firm* — Bay State IP, LLC

(57) ABSTRACT

A Lucent Waveguide Electromagnetic wave Plasma Light Source has a fabrication of fused quartz sheet and drawn tube. An inner closed void enclosure is formed of 8 mm outside diameter, 4 mm inside diameter drawn tube. Electromagnetic wave excitable plasma material is sealed inside the enclosure. The end plate is circular and has the enclosure sealed in a central bore in it, the bore not being numbered as such. A similar plate is positioned to leave a small gap between the inner end of the enclosure and itself. The two tubes are concentric with the two plates extending at right angles to their central axis. The outer tube extends back from the back surface of the inner plate as a skirt.

21 Claims, 9 Drawing Sheets

LUCENT WAVEGUIDE ELECTROMAGNETIC WAVE PLASMA LIGHT SOURCE

CROSS REFERENCE TO RELATED APPLICATION

This application is for entry into the U.S. National Phase under §371 for International Application No. PCT/GB2011/001744 having an international filing date of Sep. 20, 2011, and from which priority is claimed under all applicable sections of Title 35 of the United States Code including, but not limited to, Sections 120, 363, and 365(c), and which in turn claims priority under 35 USC 119 to United Kingdom Patent Application No. 1021811.3 filed on Dec. 21, 2010.

BACKGROUND OF THE INVENTION

1. Field of the Invention

The present invention relates to a Lucent Waveguide Electromagnetic Wave Plasma Light Source.

2. Description of the Related Art

In our European Patent No. EP2188829—Our '829 patent, there is described and claimed (as granted):

A light source to be powered by microwave energy, the source having:

- a body having a sealed void therein,
  - a microwave-enclosing Faraday cage surrounding the body,
- the body within the Faraday cage being a resonant waveguide,
- a fill in the void of material excitable by microwave energy to form a light emitting plasma therein, and
- an antenna arranged within the body for transmitting plasma-inducing, microwave energy to the fill, the antenna having:
  - a connection extending outside the body for coupling to a source of microwave energy;

wherein:

- the body is a solid plasma crucible of material which is lucent for exit of light therefrom, and
- the Faraday cage is at least partially light transmitting for light exit from the plasma crucible, the arrangement being such that light from a plasma in the void can pass through the plasma crucible and radiate from it via the cage.

As used in Our '829 patent:

"lucent" means that the material, of the item which is described as lucent, is transparent or translucent—this meaning is also used in the present specification in respect of its invention;

"plasma crucible" means a closed body enclosing a plasma, the latter being in the void when the void's fill is excited by microwave energy from the antenna.

We describe the technology protected by Our '829 patent as our "LER" technology.

We have filed a series of patent applications on improvements in the LER technology.

There are certain alternatives to the LER technology, the principal one of which is known as the Clam Shell and is the subject of our International Patent Application No PCT/GB08/003,811. This describes and claims (as published):

A lamp comprising:

- a lucent waveguide of solid dielectric material having:
  - a bulb cavity,
  - an antenna re-entrant and
  - an at least partially light transmitting Faraday cage and
- a bulb having a microwave excitable fill, the bulb being received in the bulb cavity.

The LER patent, the Clam Shell Application and the LER improvement applications have in common that they are in respect of:

A microwave plasma light source having:

- a of solid-dielectric, lucent material, having;
  - a closed void containing electro-magnetic wave, normally microwave, excitable material; and
- a Faraday cage:
  - delimiting a waveguide,
  - being at least partially lucent, and normally at least partially transparent, for light emission from it,
  - normally having a non-lucent closure and
  - enclosing the fabrication;
- provision for introducing plasma exciting electro-magnetic waves, normally microwaves, into the waveguide;

the arrangement being such that on introduction of electromagnetic waves, normally microwaves, of a determined frequency a plasma is established in the void and light is emitted via the Faraday cage.

In this specification, we refer to such a light source as a Lucent Waveguide Electromagnetic Wave Plasma Light Source, with the express proviso that this term is not necessarily intended to infer that the fabrication of solid-dielectric, lucent material fills the Faraday cage. Having rejected LUWAG EMPLIS as an acronym we use the abbreviated acronym LUWPL to refer to the light source of the previous paragraph. We pronounce this "loople".

For the purposes of this specification, we define "microwave" to mean the three order of magnitude range from around 300 MHz to around 300 GHz. We anticipate that the 300 MHz lower end of the microwave range is above that at which a LUWPL of the present invention could be designed to operate, i.e. operation below 300 MHz is envisaged. Nevertheless we anticipate based on our experience of reasonable dimensions that normal operation will be in the microwave range. We believe that it is unnecessary to specify a feasible operating range for the present invention.

In our existing LUWPLs, the fabrication can be of continuous solid-dielectric material between opposite sides of the Faraday cage (with the exception of the excitable-material, closed void) as in a lucent crucible of our LER technology. Alternatively it can be effectively continuous as in a bulb in a bulb cavity of the "lucent waveguide" of our Clam Shell. Alternatively again fabrications of as yet unpublished applications on improvements in our technology include insulating spaces distinct from the excitable-material, closed void.

Accordingly it should be noted that whereas terminology in this art prior to our LER technology includes reference to an electroplated ceramic block as a waveguide and indeed the lucent crucible of our LER technology has been referred to as a waveguide; in the this specification, we use "waveguide" to indicate jointly:

- the enclosing Faraday cage, which forms the waveguide boundary,
- the solid-dielectric lucent material fabrication within the cage,
- other solid-dielectric material, if any, enclosed by the Faraday cage and
- cavities, if any, enclosed by the Faraday cage and devoid of solid dielectric material, the solid-dielectric material, together the effect of the plasma and the Faraday cage, determining the manner of propagation of the waves inside the cage.

Insofar as the lucent material may be of quartz and/or may contain glass, which materials have certain properties typical of solids and certain properties typical of liquids and as such are referred to as super-cooled liquids, super-cooled liquids are regarded as solids for the purposes of this specification.

Also for the avoidance of doubt "solid" is used in the context of the physical properties of the material concerned and not to infer that the component concerned is continuous as opposed to having voids therein.

There is a further clarification of terminology required. Historically a "Faraday cage" was an electrically conductive screen to protect occupants, animate or otherwise, from external electrical fields. With scientific advance, the term has come to mean a screen for blocking electromagnetic fields of a wide range of frequencies. A Faraday cage will not necessarily block electromagnetic radiation in the form of visible and invisible light. Insofar as a Faraday cage can screen an interior from external electromagnetic radiation, it can also retain electromagnetic radiation within itself. Its properties enabling it to do the one enable it to do the other. Whilst it is recognised that the term "Faraday cage" originates in respect of screening interiors, we have used the term in our earlier LUWPL patents and applications to refer to an electrical screen, in particular a lucent one, enclosing electromagnetic waves within a waveguide delimited by the cage. We continue with this use in this present specification.

SUMMARY OF THE INVENTION

The object of the present invention is to provide an improved Lucent Waveguide Electromagnetic Wave Plasma Light Source or LUWPL.

According to the invention there is provided a Lucent Waveguide Electromagnetic Wave Plasma Light Source comprising:

- a fabrication of solid-dielectric, lucent material, the fabrication providing at least:
  - a closed void containing electromagnetic wave excitable plasma material;
- a Faraday cage:
  - enclosing the fabrication,
  - being at least partially lucent, for light emission from it and
  - delimiting a waveguide, the waveguide having:
    - a waveguide space, the fabrication occupying at least part of the waveguide space; and
- at least partially inductive coupling means for introducing plasma exciting electromagnetic waves into the waveguide at a position at least substantially surrounded by solid dielectric material;
- whereby on introduction of electromagnetic waves of a determined frequency a plasma is established in the void and light is emitted via the Faraday cage;
  - the arrangement being such that there is:
    - a first region of the waveguide space extending between opposite sides of the Faraday cage at this region, this first region:
      - accommodating the inductive coupling means and having a relatively high volume average dielectric constant and
    - a second region of the waveguide space extending between opposite sides of the Faraday cage at this region, this second region:
      - having a relatively low volume average dielectric constant.

We determine whether the coupling means is or is not "at least partially inductive" in accordance with whether or not the impedance of the light source, assessed at an input to the coupling means has an inductive component.

We can envisage certain arrangements in which the coupling means may not be totally surrounded by solid dielectric material. For instance, the coupling means may extend from solid dielectric material in the waveguide space and traverse an air gap therein. However we would not normally expect such air gap to exist.

The excitable plasma material containing void can be arranged wholly within the second, relatively low average dielectric constant region. Alternatively, it can extend through the Faraday cage and be partially without the cage and the second region.

In certain embodiments, the second region extends beyond the void in a direction from the inductive coupling means past the void. This is not the case in the first preferred embodiment described below.

Normally, the fabrication will have at least one cavity distinct from the plasma material void. In such case, the cavity can extend between an enclosure of the void and at least one peripheral wall in the fabrication, the peripheral wall having a thickness less than the extent of the cavity from the enclosure to the peripheral wall.

In a possible, but not preferred embodiment, the fabrication has at least one external dimension which is smaller than the respective dimension of the Faraday cage, the extent of the portion of the waveguide space between the fabrication and the Faraday cage being empty of solid dielectric material.

In another possible, but not preferred embodiment, the fabrication is arranged in the Faraday cage spaced from an end of the waveguide space opposite from its end at which the inductive coupler is arranged.

In another embodiment, the solid dielectric material surrounding the inductive coupling means is the same material as that of the fabrication.

In the first, preferred embodiment described below, the solid dielectric material surrounding the inductive coupling means is a material of a higher dielectric constant than that of the fabrication's material, the higher dielectric constant material being in a body surrounding the inductive coupling means and arranged adjacent to the fabrication.

Normally, the Faraday cage will be lucent for light radiation radially thereof. Also the Faraday cage is preferably lucent for light radiation forwardly thereof, that is away from the first, relatively high dielectric constant region of the waveguide space.

Again, normally the inductive coupling means will be or include an elongate antenna, which can be a plain wire extending in a bore in the body of relatively high dielectric constant material. Normally the bore will be a through bore in the said body with the antenna abutting the fabrication. A counterbore can be provided in the front face of the separate body abutting the rear face of the fabrication and the antenna is T-shaped (in profile) with its T head occupying the counterbore and abutting the fabrication.

In accordance with another aspect of the invention, there is provided a Lucent Waveguide Electromagnetic Wave Plasma Light Source comprising:

- a fabrication of solid-dielectric, lucent material, the fabrication providing at least:
  - an enclosure of a closed void containing electromagnetic wave excitable plasma material;
- a Faraday cage:
  - enclosing the fabrication,
  - being at least partially lucent, for light emission from it and delimiting a waveguide, the waveguide having:

a waveguide space, the fabrication occupying at least part of the waveguide space and the waveguide space having:

an axis of symmetry; and at least partially inductive coupling means for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

wherein:

the arrangement is such that with the waveguide space notionally divided into equal front and rear semi-volumes:

the front semi-volume is:

at least partially occupied by the fabrication with the said void in the front semi-volume and is enclosed (except at the rear semi-volume) by a front, lucent portion of the Faraday cage via which portion light from the void can radiate, the rear semi-volume has the inductive coupler extending in it and the volume average of the dielectric constant of the content of the front semi-volume is less than that of the rear semi-volume.

The difference in front and rear semi-volume volume average of dielectric constant can be caused by the said fabrication having end-to-end asymmetry and/or being asymmetrically positioned in the Faraday cage.

Preferably:

the said fabrication occupies the entire waveguide space, at least one evacuated or gas-filled cavity is included in the fabrication within the front semi-volume, thereby providing the lower volume average of dielectric constant of the front semi-volume, and the cavity extends between the enclosure of the void and at least one peripheral wall in the fabrication, the peripheral wall having a thickness less than the extent of the cavity from the enclosure of the void to the peripheral wall.

Possibly:

the said fabrication occupies a front part of the waveguide space, a separate body of the same material occupies the rest of the waveguide space and at least one evacuated or gas-filled cavity is included in the fabrication within the front semi-volume, thereby providing the lower volume average of dielectric constant of the front semi-volume, and the cavity extends between the enclosure void and at least one peripheral wall in the fabrication, the peripheral wall having a thickness less than the extent of the cavity from the enclosure of the void to the peripheral wall.

Further, preferably:

the said fabrication occupies a front part of the entire waveguide space and a separate body of higher dielectric constant material occupies the rest or at least the majority of the waveguide space.

Where a separate body is used of the same or different dielectric material to that of the fabrication, the inductive coupling means can extend beyond the rear semi-volume into the front semi-volume as far as the fabrication.

Again, preferably:

at least one evacuated or gas-filled cavity is included in the fabrication within the front semi-volume, thereby enhancing the difference in the dielectric-constant, volume averages between the front and rear semi-volumes, and the cavity extends between the enclosure of the void and at least one peripheral wall in the fabrication, the peripheral wall having a thickness less than the extent of the cavity from the enclosure of the void to the peripheral wall.

Whilst, the or each cavity can be evacuated and/or gettered, normally the or each cavity will be occupied be a gas, in particular nitrogen, at low pressure of the order of one half to one tenth of an atmosphere. Possibly the or each cavity can be open to the ambient atmosphere.

It is possible for the enclosure void to extend laterally of the cavity, crossing a central axis of the fabrication. However, normally the enclosure of the void will extend on the central longitudinal, i.e. front to rear, axis of the fabrication.

The enclosure of the void can be connected to both a rear wall and a front wall of the fabrication. However, preferably the enclosure of the void is connected to the front wall only of the fabrication.

Preferably, the enclosure of the void extends through the front wall and partially through the Faraday cage.

Possibly the front wall can be domed. However, normally the front wall will be flat and parallel to a rear wall of the fabrication.

Normally, the enclosure of the void and the rest of the fabrication will be of the same lucent material. Nevertheless, the enclosure of the void and at least outer walls of the fabrication can be of the differing lucent material. For instance, the outer walls can be of cheaper glass for instance borosilicate glass or aluminosilicate glass. Further, the outer wall(s) can be of ultraviolet opaque material.

In the preferred embodiment, the part of the waveguide space occupied by the fabrication substantially equates to the front semi-volume.

Where provided, the separate body could be spaced from the fabrication, but preferably it abuts against a rear face of the fabrication and is located laterally by the Faraday cage. The fabrication can have a skirt with the separate body both abutting a rear face of the fabrication and being located laterally within the skirt.

Preferably the void enclosure is tubular.

Preferably the fabrication and the separate body of solid dielectric material, where provided, are bodies of rotation about a central longitudinal axis.

Alternatively, the fabrication and solid body can be of other shapes for instance of rectangular cross-section.

Conveniently the LUWPL is provided in combination with a electromagnetic wave circuit having:

an input for electromagnetic wave energy from a source thereof and an output connection thereof to the inductive coupling means of the LUWPL;

wherein the electromagnetic wave circuit is a complex impedance circuit configured as a bandpass filter and matching output impedance of the source of electromagnetic wave energy to inductive input impedance of the LUWPL.

Preferably the electromagnetic wave circuit is a tunable comb line filter; and.

The electromagnetic wave circuit can comprise:

a metallic housing, a pair of perfect electric conductors (PECs), each grounded inside the housing, a pair of connections connected to the PECs, one for input and the other for output and a respective tuning element provided in the housing opposite the distal end of each PEC.

A further tuning element can be provided in the iris between the PECs.

In accordance with a third aspect of the invention, there is provided a Lucent Waveguide Electromagnetic Wave Plasma Light Source comprising:

a fabrication of solid-dielectric, lucent material, the fabrication providing at least:

a closed void containing electromagnetic wave excitable plasma material;

a Faraday cage:

enclosing the fabrication, being at least partially lucent, for light emission from it and delimiting a waveguide, the waveguide having:

a waveguide space, the fabrication occupying at least part of the waveguide space; and at least partially inductive coupling means for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

wherein:

the fabrication is of quartz and a body of alumina is provided in the waveguide space to raise the volume average of the dielectric constant of the waveguide space, the inductive coupling means being provided in the alumina body.

Conveniently, the fabrication and the alumina body together fill the waveguide space.

In accordance with a fourth aspect of the invention, there is provided a Lucent Waveguide Electromagnetic Wave Plasma Light Source comprising:

a fabrication of solid-dielectric, lucent material, the fabrication providing at least:

a closed void containing electromagnetic wave excitable plasma material;

a Faraday cage:

enclosing the fabrication, being at least partially lucent, for light emission from it and delimiting a waveguide, the waveguide having:

a waveguide space, the fabrication occupying at least part of the waveguide space; and at least partially inductive coupling means for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

wherein:

the volume average of the dielectric constant of the fabrication is less that the dielectric constant of its material.

According to a fifth embodiment of the invention there is provided a Lucent Waveguide Electromagnetic Wave Plasma Light Source comprising:

a fabrication of solid-dielectric, lucent material, the fabrication providing at least:

a closed void containing electromagnetic wave excitable plasma material;

a Faraday cage:

enclosing the fabrication, being at least partially lucent, for light emission from it and delimiting a waveguide, the waveguide having:

a waveguide space, the fabrication occupying at least part of the waveguide space; and at least partially inductive coupling means for introducing plasma exciting electromagnetic waves into the waveguide at a position at least substantially surrounded by solid dielectric material;

a body of solid dielectric material in the waveguide space, the body abutting the fabrication and having the inductive coupling means extending in it, whereby on introduction of electromagnetic waves of a determined frequency a plasma is established in the void and light is emitted via the Faraday cage.

Conveniently:

the inductive coupling means extends as far as the abuttal interface between the body and the fabrication:

the fabrication and the body are of the same material:

Alternatively:

the fabrication and the body are of differing materials, the body having a higher dielectric constant.

The separate bodies where provided can be abutted against a rear face of the fabrication and be located laterally by the Faraday cage. However, preferably, the fabrication has a skirt with the separate body both abutting the rear face of the fabrication and being located laterally within the skirt.

According to the sixth embodiment of the invention, there is provided a light emitter for use with a source of electromagnetic waves, an antenna and a Faraday cage, the light emitter comprising:

an enclosure of lucent material, having at least one outer wall and a back wall;

a cavity within the enclosure;

an excitable-material-containing bulb extending into the cavity from at least one of the walls of the cavity, the bulb having a void containing excitable material and a body of solid dielectric material fitted to the enclosure, having a front face complementary with the back wall of the cavity and an antenna bore;

the arrangement of the light emitter being such that the combination of the enclosure including the bulb and the body, when surrounded by the Faraday cage, form an electro-magnetically resonant system in which resonance can be established by application of electromagnetic waves to the antenna in the bore for emission of light from a plasma in the excitable material.

For the avoidance of doubt, the above statement of invention is that set out in the priority application No GB1021811.3. It is recognised to be narrower than some of the other statements of invention set out above. The following paragraphs down to the description of the drawings are also taken verbatim from the priority application. Their subject matter is not limited to the narrow priority statement of invention, but is applicable to the invention as stated broadly above and indeed as claimed below.

It should also be noted that in these paragraphs, the term:

"enclosure" refers to the "fabrication" of the above paragraphs at least where the fabrication includes a cavity distinct from the void enclosure and "bulb" refers to the "void enclosure" of the above paragraphs.

Whilst the body could be of the same lucent material as the enclosure, with the primary difference from the LERs of our WO 2009/063205 application, being the provision of the cavity in which the bulb extends; preferably, the body of solid dielectric material will be of higher dielectric constant than the lucent material of the enclosure and normally will be opaque.

It should be particularly noted that we expect certain embodiments of the present invention to fall within the scope of the LER patents, because these are broad patents.

The cavity can be open, allowing air or other ambient gas into the enclosure to substantially surround the bulb. However the cavity will normally be closed and sealed, with either a vacuum in the enclosure or a specifically introduced gas.

The enclosure and the cavity sealed within it can be of a variety of shapes. Preferably the enclosure is a body of rotation. It could be spherical, hemispherical with a plane back wall for abutting a plane front face of the solid dielectric body, or as in the preferred embodiment, circularly cylindrical, again with a plane back wall for abutting the solid dielectric body.

Normally the enclosure will have constant thickness walls, whereby the enclosure and the cavity will have the same shape.

Whilst it is envisaged that the bulb could be spherical, it is preferably elongate with a circular cross-section, typically being formed of tubular material closed at opposite ends, The bulb can extend into the cavity from a front wall of the enclosure towards its back wall. Alternatively, it can extend from a side wall of the enclosure parallel with the back wall.

It can also be envisaged that the bulb could extend from the back wall of the enclosure.

Whilst it can be envisaged that the bulb could be connected to walls of the enclosure at opposite sides/ends of the bulb, it is preferably connected to one wall only. In this way the material of the bulb is substantially thermally isolated from the material of the enclosure; albeit that they are preferably of the same lucent material.

Normally the bulb, or part of it will be at the centre of the light emitter, experiencing the highest electric field during resonance.

In a simple arrangement, the enclosure and the solid body can be of equal diameters and abutted together, back wall to front face, being held against each other by the Faraday cage. However it is preferred that the enclosure is extended backwards with a rim fitting a complementary rebate in the body or with a skirt within which the body is received.

Preferably, the bore in the body for the antenna is central and passes to the front face of the body, whither the antenna extends, with the bulb being arranged to have a portion thereof spaced from the back wall of the enclosure by a small proportion of the enclosure's front to back dimension. In the preferred embodiment, the front face of the body has a recess occupied by a button head of the antenna.

Alternatively, it can be envisaged that the antenna could be:

- eccentric in the body, either terminating as a rod at the front face of the body or with a button or
- eccentric in the body and extending in to the enclosure, conveniently via an aperture opening in the cavity to ambient, or via a closed end tube extending into the cavity from the back wall whereby the cavity can be sealed.

BRIEF DESCRIPTION OF THE DRAWINGS

To help understanding of the invention, a specific embodiment thereof will now be described by way of example and with reference to the accompanying drawings, in which.

DETAILED DESCRIPTION OF THE PREFERRED EMBODIMENTS

Figure 1:
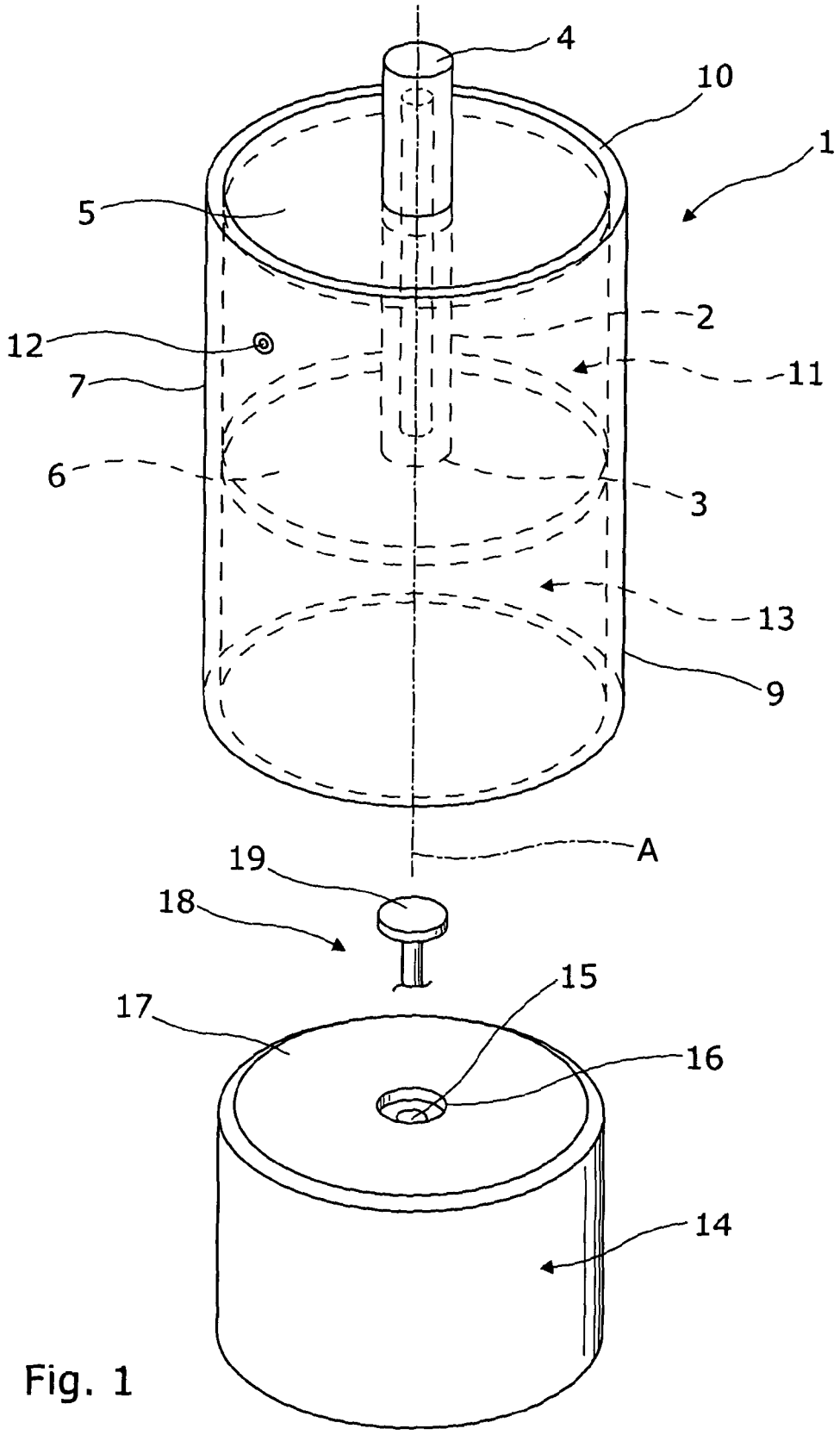
FIG. 1 is an exploded view of a quartz fabrication, an alumina block and an aerial of an LUWPL in accordance with the invention.
Figure 2:
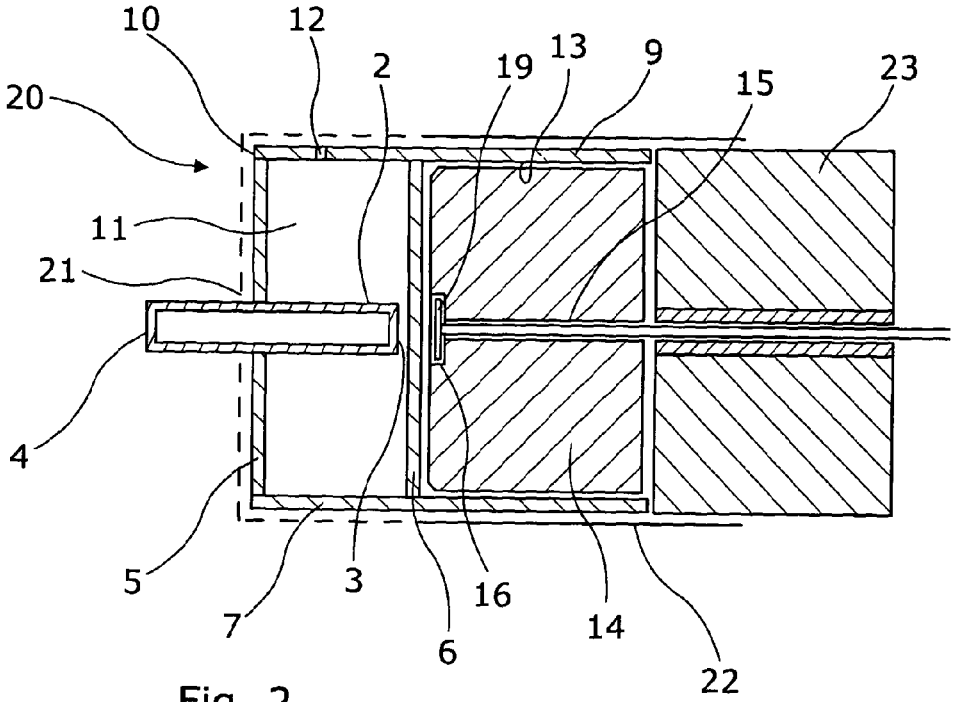
FIG. 2 is a central, cross-sectional side view of the LUWPL of FIG. 1.
Figure 3:
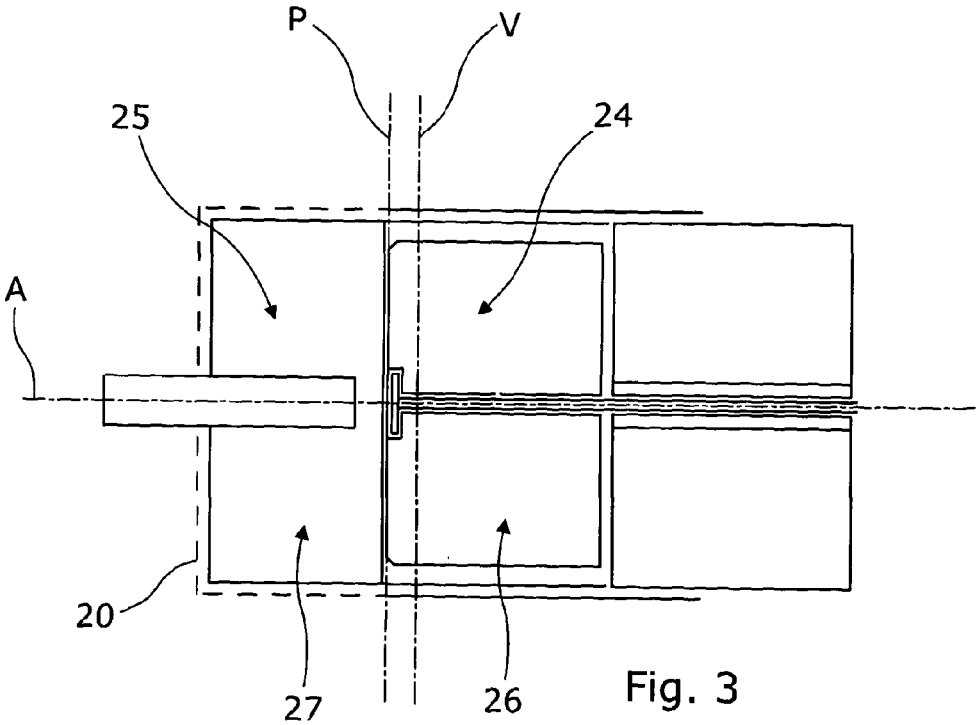
FIG. 3 is a diagrammatic view similar to FIG. 2 of the LWMPLS.

Referring to FIGS. 1 to 3 of the drawings, the Lucent Waveguide Electromagnetic Wave Plasma Light Source thereshown is a prototype structure. It has been tested and found to operate. Indeed it is expected that the production version will be similar to that shown in the drawings and described below. It has a fabrication 1 of quartz, that is to say fused as opposed to crystalline silica sheet and drawn tube. An inner closed void enclosure 2 is formed of 8 mm outside diameter, 4 mm inside diameter drawn tube. It is sealed at its inner end 3 and its outer end 4. The methods of sealing known from our International Patent Applications Nos WO 2006/070190 and WO2010/094938 are suitable. Microwave excitable plasma material is sealed inside the enclosure. Its outer end 4 protrudes through an end plate 5 by approximately 10.5 mm and the overall length of the enclosure is approximately 20.5 mm.

The end plate 5 is circular and has the enclosure 2 sealed in a central bore in it, the bore not being numbered as such. The plate is 2 mm thick. A similar plate 6 is positioned to leave a 10 mm separation between them with a small approximately 2 mm gap between the inner end of the enclosure and the inner plate 6. The plates are 34 mm in diameter and sealed in a drawn quartz tube 7, the tube having a 38 mm outside diameter and 2 mm wall thickness. The arrangement places the two tubes concentric with the two plates extending at right angles to their central axis. The concentric axis A and is the central axis of the waveguide as defined below.

The outer end 10 of the outer tube 7 is flush with the outside surface of the outer plate 5 and the inner end of the tube extends 17.5 mm back from the back surface of the inner plate 6 as a skirt 9. This structure provides:

- an annular cavity 11 between the plates, around the void enclosure and within outer tube. The outer tube has a sealed point 12, through which the cavity is evacuated and refilled with low pressure nitrogen having a pressure of the order of one tenth of an atmosphere;
- a skirted recess 13.

Accommodated in the skirted recess is a right-circular-cylindrical block 14 of alumina dimensioned to fit the recess with a sliding fit. Its outside diameter is 33.9 mm and it is 17.7 mm thick. It has a central bore 15 of 2 mm diameter and a counter-bore 16 of 6 mm diameter and 0.5 mm depth in its outer face 17 abutting the back face of the inner plate 6. The rim of the outer face is chamfered against sealing splatter preventing the abuttal being close. An antenna 18 with a Tee/button head 19 is housed in the bore 15 and counter-bore 16.

The quartz fabrication 1 is accommodated in hexagonal perforated Faraday cage 20. This extends across the fabrication at the end plate 5 and back along the outer tube for the extent of the cavity 10. The cage has a central aperture 21 for the outer end of the void enclosure and an imperforate skirt 22 extending 8 mm further back than the quartz skirt 9, which accommodates the alumina block 14. An aluminium chassis block 23 carries the fabrication and the alumina body, with the imperforate cage skirt partially overlapping the aluminium block. Thus, the Faraday cage holds these two components together and against the block 23. Not only does the block provide mechanical support, but also electro-magnetic closure of the Faraday cage.

The above dimensions provide for the Faraday cage to be resonant at 2.45 GHz.

The waveguide space being the volume within the Faraday cage is notionally divided into two regions divided by the plane P at which the alumina block 14 abuts the inner plate 6 of the fabrication. The first inner region 24 contains the antenna, but this has negligible effect on the volume average of the dielectric constant of the material in the region. Within the region are the alumina block and the quartz skirt. These contribute to the volume averages as follows:

Alumina block 14: Volume=$\pi\times(33.9/2)^2\times17.7=15967.7$,
Dielectric constant=9.6,
Volume×Dielectric constant=153289.9.

Quartz Skirt 9 Volume=$\pi\times((38/2)^2-(34/2)^2)\times18=4069.4$,
Dielectric constant=3.75,
Volume×D. constant=15260.3.

First Region 24 Volume=$\pi\times((38/2)^2)\times18=20403.7$
Volume average dielectric constant=(153289.9+15260.3)/20403.7=8.26.

The second region 25 comprises the fabrication less the skirt. Its part contribute to the volume averages as follows:

Void Enclosure Volume=$\pi\times((8/2)^2-(4/2)^2)\times8=301.4$,
Dielectric constant=3.75,
Volume×D. constant=1130.3.

Cavity Enclosure Volume=$\pi\times((38/2)^2-(34/2)^2)\times10=2260.8$,
Dielectric constant=3.75,
Volume×D. constant=8478.1.

Outer Plate Volume=$\pi\times((38/2)^2)\times2=2267.1$,
Dielectric constant=3.75,
Volume×D. constant=8501.6.

Inner Plate Volume=$\pi\times((38/2)^2)\times2=2267.1$,
Dielectric constant=3.75,
Volume×D. constant=8501.6.

Cavity Volume=Entire volume less sum of quartz parts=15869.5−301.4−2260.8−2267.1−2267.1=8773.1,
Dielectric constant=1.00,
Volume×D. constant=8773.1.

Second Region 25 Volume=$\pi\times((38/2)^2)\times14=15869.5$
Volume average dielectric constant=(1130.3+8478.1+8501.6+8501.6+8773.1)/15869.5=2.23.

It can thus be seen the volume averaged dielectric constant of the first region is markedly higher than that of the second region. This is due to the high dielectric constant of the alumina block. In turn the result of this is that the first region has a predominant effect on the resonant frequency of combination of parts contained within the wave guide.

The contrasting average values for the two regions, 8.26 and 2.23, can be usefully contrasted with the average for the entire waveguide space of (20403.7×8.26)+(15869.5×2.23)/(20403.7+15869.5)=5.62.

If the comparison of regions is not done of the basis of the first and second regions being divided by the abuttal plane between the fabrication and the alumina block, but between the two equal semi-volumes the comparison has an essentially similar result. The division plane V, parallel to the abutment plane, falls 1.85 mm into the alumina block. The latter is uniform in the direction of the axis A. Therefore the volume average of the first, rear semi-volume 26 remains 8.26. The second, other, front semi-volume 27 has a contribution from the slice of alumina and quartz skirt. This contribution can be calculated from its volume average dielectric constant:

1.85 mm slice Volume=$\pi\times(38/2)^2\times1.85=301.4$,
Dielectric constant=8.26,
Volume×D. constant=2097.0.

Front Semi-Volume Volume=$\pi\times((38/2)^2)\times14+\pi\times(38/2)^2\times1.85=15869.5+301.4=16170.9$
Volume average dielectric constant=(15869.5×2.23+2097.0)/16170.9=2.32.

Thus for this particular embodiment, using quartz, alumina, 2 mm wall thickness and an operating frequency of 2.45 GHz, the difference in ratio between:

Front/Rear Regions at 2.23:8.26 as against
Front/Rear Semi-Volumes 2.32:8.26.

This is a Ratio of 0.270:0.280 or 0.96:1.00.

Thus it can be said that the two ratios are alternative comparisons which are both determinative of the same inventive concept.

It will be noted that this LUWPL is appreciably smaller than an LER quartz crucible operating at 2.45 GHz, eg 49 mm in diameter by 19.7 mm long.

Figure 4:
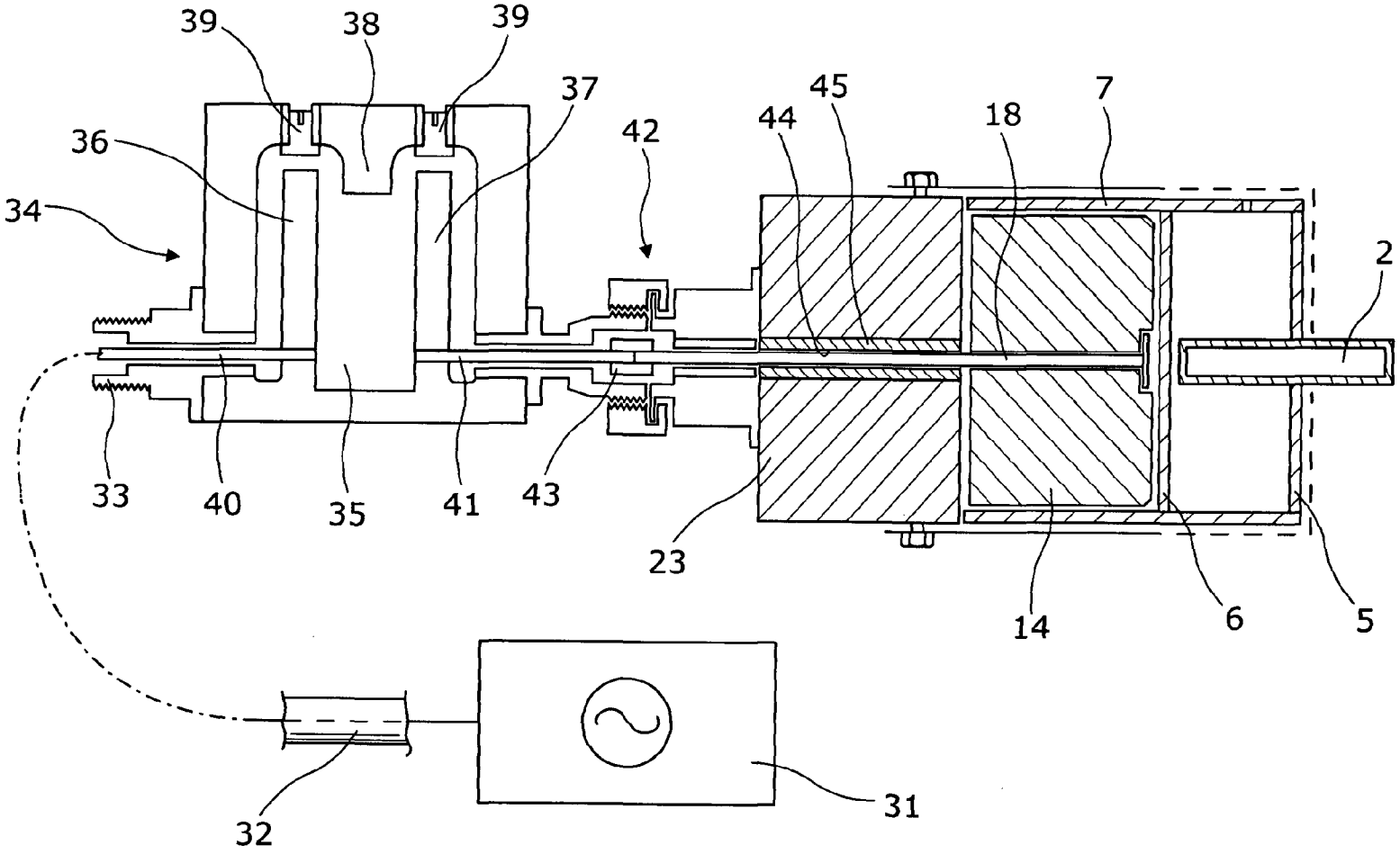
FIG. 4 is a cross-sectional view of the LUWPL of FIG. 1, together with a matching circuit for conducting microwaves to the LUWPL, as arranged for prototype testing.

Turning now to FIG. 4, and bearing in mind that the prototype structure of FIGS. 1 to 3 is dimensioned to operated at 2.45 GHz, FIG. 4 shows a combination of the LUWPL structure and a bandpass filter for matching generated microwaves to the LUWPL. In production at this frequency, these would be generated by a magnetron. In prototype testing, they were generated by a bench oscillator 31 and fed by coaxial cable 32 to the input connector 33 of a band pass filter 34. This is embodied as an air waveguide 35 having two perfect electric conductors (PECs) 36,37 arranged for input and output of microwaves. A third PEC 38 is provided in the iris between the two. Tuning screws 39 are provided opposite the distal ends of the PECs. The input PEC is connected by a wire 40 to the core of the coax cable 32. The output is connected to another wire 41, which is connected through to the antenna 18 via a pair of connectors 42, central to which is a junction sleeve 43. Intermediate the filter 34 and the LUWPL, the aluminium chassis block 23 is provided. It has a bore 44 through which the wire 41 extends, with the interposition of a ceramic insulating sleeve 45.

It should be noted that the arrangement described may not start spontaneously. In prototype operation, the plasma can be initiated by excitation with a Tesla coil device. Alternatively, the noble gas in the void can be radio-active such as Krypton 85. Again, it is anticipated that the plasma discharge can be initiated by apply a discharge of the automotive ignition type to an electrode positioned close to the end 4 of the void enclosure.

The resonant frequency of the fabrication and alumina block system changes marginally between start up when the plasma is only just establishing and full power when the plasma is full established and acts as a conductor within the plasma void. It is to accommodate this that a bandpass filter, such as described, is used between the microwave generator and the LUWPL.

Figure 5:
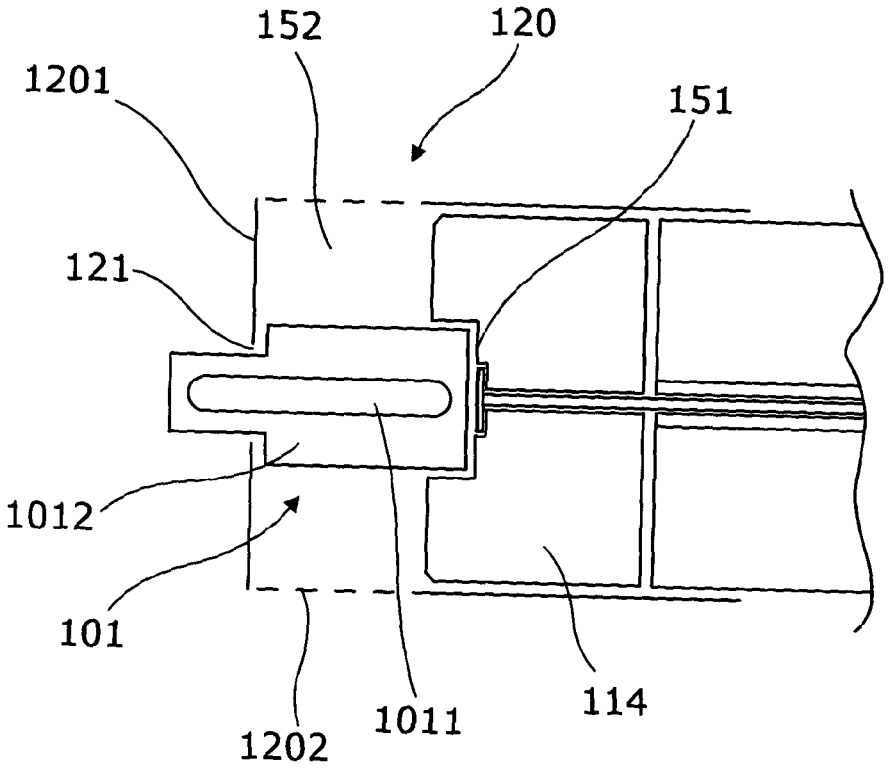
FIG. 5 is a view similar to FIG. 3 of a modified LUWPL.

Turning now to FIG. 5, there is shown a modified LUWPL in which the fabrication 101 has a smaller over all diameter than the alumina block 114 and the Faraday cage 120. The front face of the alumina block has a shallow recess 151 sized to receive and locate the back of the fabrication. The front of the fabrication is located in an aperture 121 in the front of the Faraday cage. This can have a metallic disc 1201 extending laterally to perforated cylindrical portion 1202, through which light can radiate from a plasma in a void 1011 in the fabrication. The arrangement leaves an annular air gap 152 around the fabrication and within the Faraday cage, which contributes to the low volume average dielectric constant of the fabrication region. Whilst an annular cavity such as the cavity 10 could be provided, it would be narrow and it is preferable for the fabrication to be formed with a solid wall 1012 around the void 1011. This variant has the advantage of simpler forming of the fabrication, but is not expected to have such good coupling of microwave energy from the antenna to the plasma. Further light propagating axially of the fabrication will not be able to radiate in this direct through the Faraday cage, being reflected by the disc 1201. However this is not necessarily a disadvantage in that most of the light radiates radially from the fabrication and will collected for collimation by a reflector (not shown) outside the LUWPL.

Figure 6:
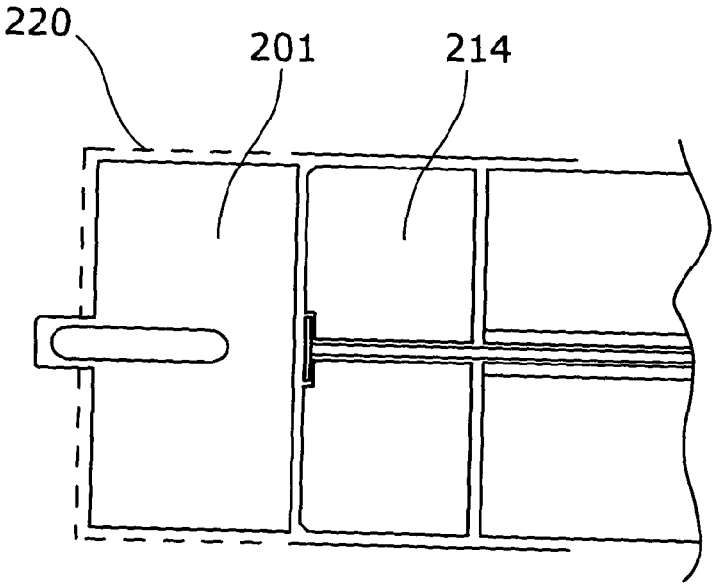
FIG. 6 is a similar view of another modified LUWPL.

Turning to another modified LUWPL as shown in FIG. 6, the fabrication 201 is the same diameter as the alumina block 214 and the Faraday cage 220. However it is of solid quartz. This has a less marked difference of volume average dielectric constant between the regions defined by the fabrication and the block, being the difference between the dielectric constants of their respective materials.

Figure 7:
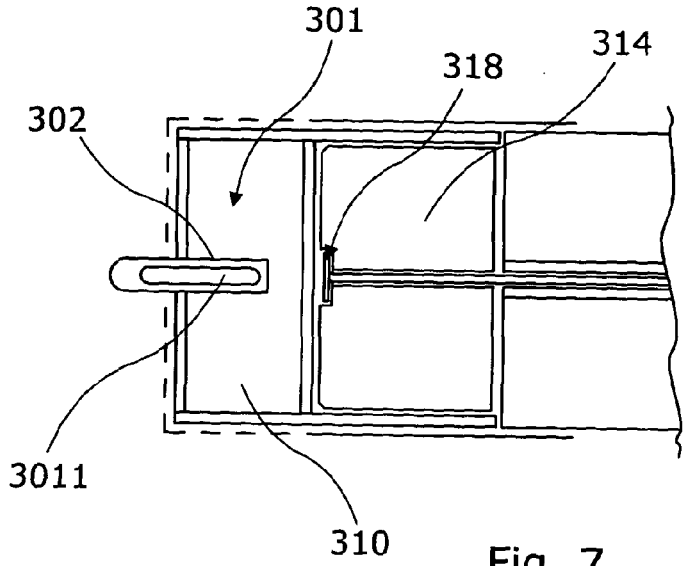
FIG. 7 is a similar view of a third modified LUWPL.

In the modified LUWPL of FIG. 7, the fabrication 301 is effectively identical to that 1 of the first embodiment. The difference is in the solid dielectric block being a quartz block 314. As shown the quartz block is separate from the fabrication. However it could be part of the fabrication. This arrangement would provide fewer interfaces between the antenna 318 and the void 3011. This is believed to be of advantage in enhancing the coupling from the antenna to the void. The dielectric constant volume average difference between the fabrication and the block or at least the solid piece of quartz in which the antenna extends is less, relying on the presence of the annular cavity 310 around the void enclosure 302.

Figure 8:
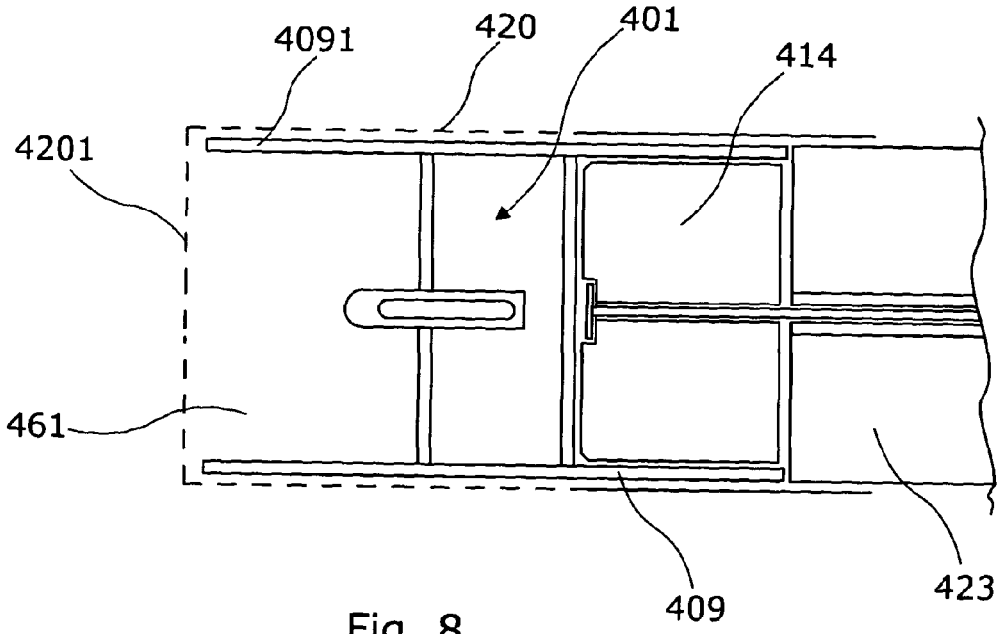
FIG. 8 is a similar view of a fourth modified LUWPL.

In another modification, as shown in FIG. 8, the fabrication 401 has a to forward extending skit 4091 in addition to the skirt 409 around the alumina block 414. With a portion 461 of the waveguide space enclosed within the Faraday cage 420 being empty and thus enhancing the dielectric constant volume average difference. The skirt 4091 supports the Faraday cage and enables the latter at it is front disc 4201, which can be perforate or not, to retain the fabrication and the block against the chassis block 423.

Figure 9:
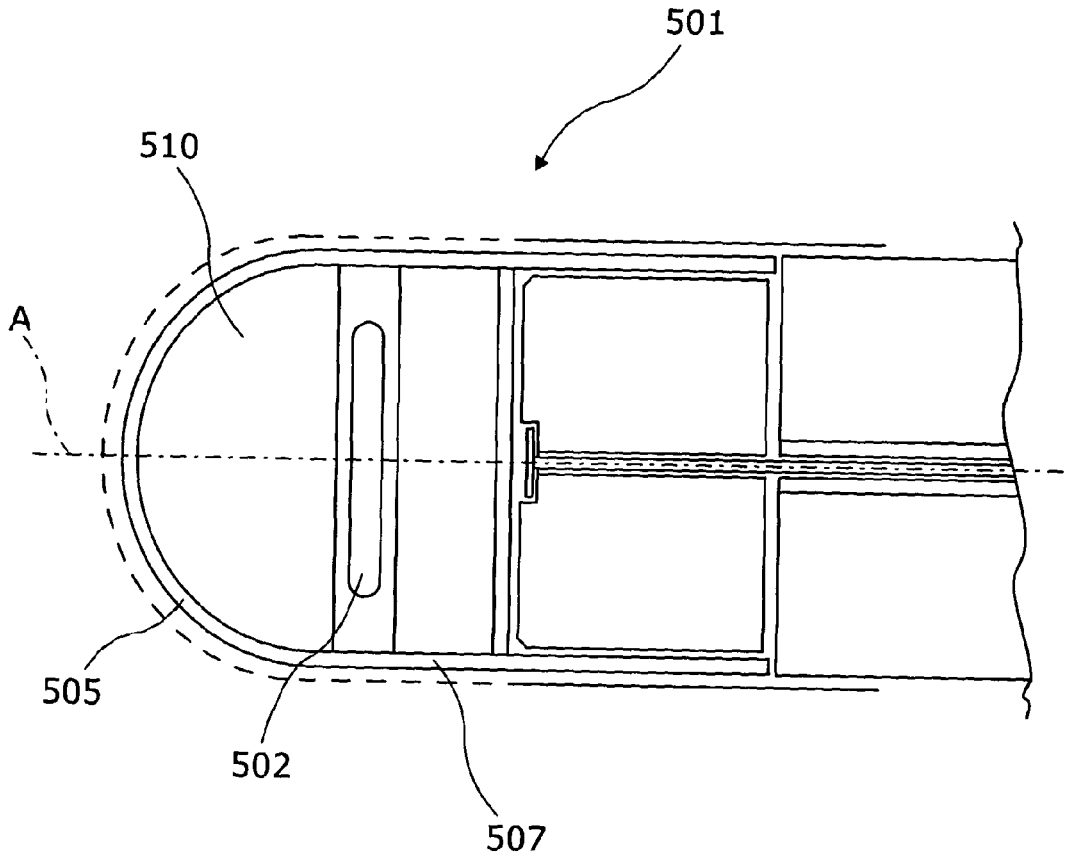
FIG. 9 is a similar view of a fifth modified LUWPL.

In yet another modification, shown in FIG. 9, the fabrication 501 is essentially similar to that 1 of FIGS. 1 & 2 except for two features. Firstly the plasma void enclosure 502 is oriented transversely with respect to the longitudinal axis A of the waveguide space. The enclosure is sealed into opposite sides of the 507 of the cavity 510 of the surrounding the enclosure. Further the front plate is replaced by a dome 505.

Figure 10:
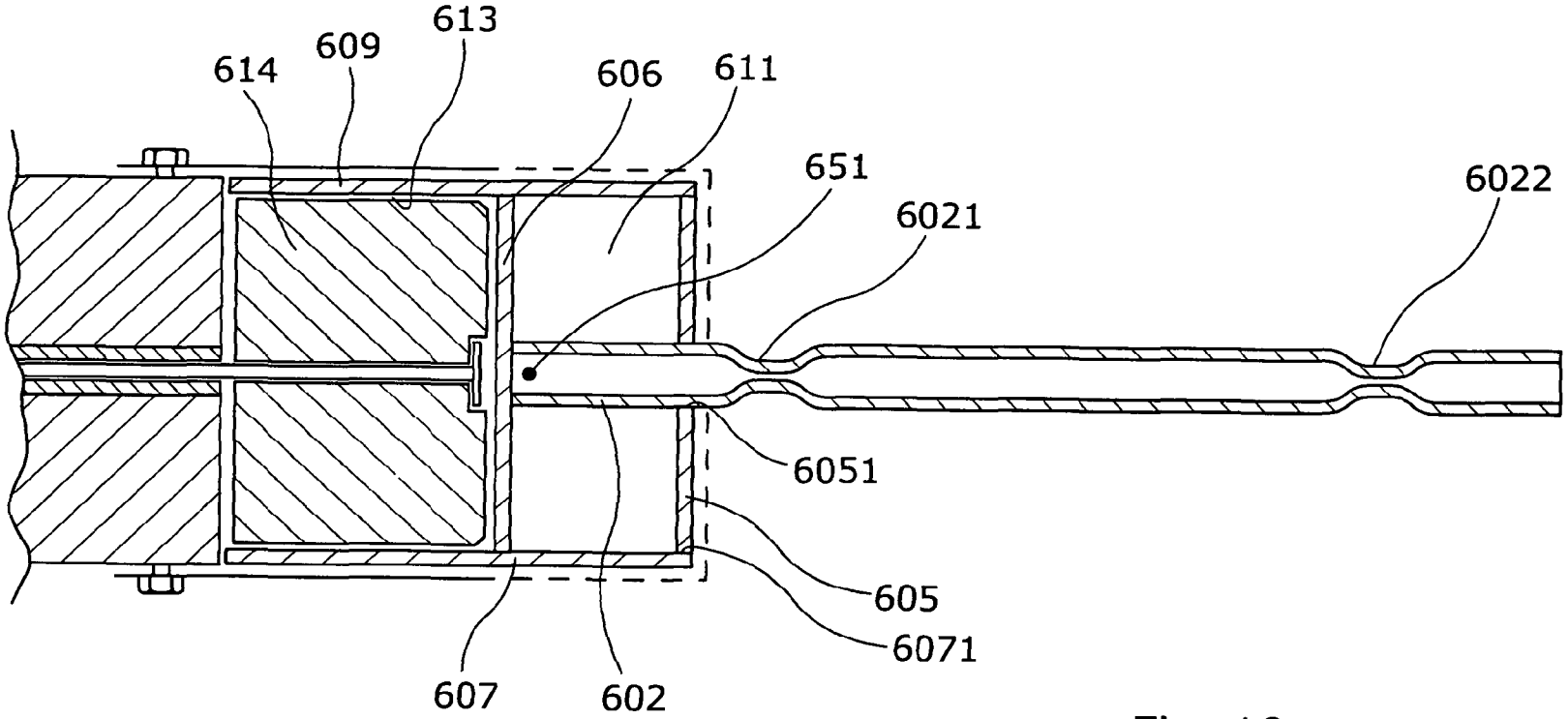
FIG. 10 is a similar view of a sixth modified LUWPL.

Turning to FIG. 10, the LUWPL there shown has a slightly different fabrication to that of FIGS. 1 to 4. It will be described with reference to its method of fabrication:

1. To a disc 606 of quartz, a small diameter tube 602 of quartz is sealed centrally. The tube has a near neck 6021 and a far neck 6022;
2. A length 607 of large diameter tube is sealed to the disc 606, in a manner to provide for a cavity 611 and a recess 613 for an alumina block 614 within a skirt 609;
3. A further, front disc 605 of quartz with a central bore 6051 is sealed to the rim 6071 of the large diameter tube and to the smaller diameter tube, with the near neck just outside the front disc;
4. A pellet 651 of microwave excitable material is dropped into the inner tube, which is evacuated, back-filled with noble gas and sealed at the outer neck;
5. The inner tube is then sealed at the inner neck.

Normally the components that are sealed to form the fabrications will be of quartz which is transparent to a wide spectrum of light. However, where it is desired to restrict the emission of certain coloured light and/or certain invisible light such as ultra-violet light, quartz which is opaque to such light can be used for the outer components of the fabrication or indeed for the whole fabrication. Again, other parts of the fabrication, apart from the void enclosure can be made of less expensive glass material.

Figure 11:
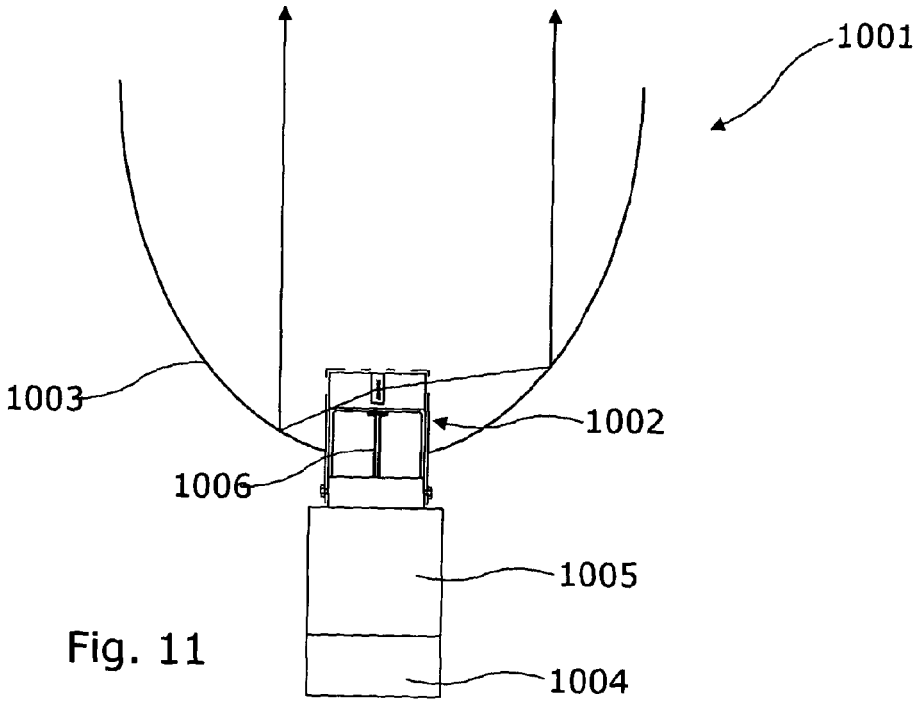
FIG. 11 is a diagrammatic side view of a light emitter of the invention in a lamp, together with Faraday cage, a magnetron, a matching circuit and an antenna as described in the priority application No GB1021811.3.
Figure 12:
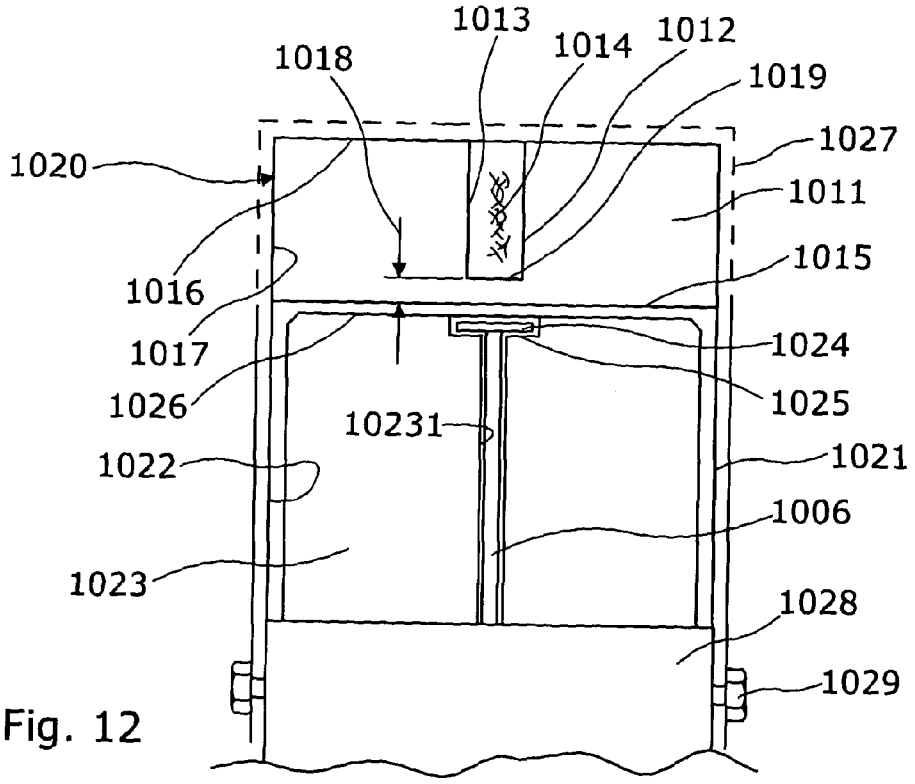
FIG. 12 is a diagrammatic view on a larger scale of light emitter of FIG. 10.

The embodiment described above with reference to FIGS. 1 to 4 is of the prototype as tested, which represents the best manner of which we are aware for working the invention. For the avoidance of doubt, the description of British Patent Application No GB 1021811.3, the priority application, is now repeated verbatim below, with reference to FIGS. 11 to 14 and addition of 1000 to the reference numerals:

Referring first to FIGS. 11 & 12 of the drawings, a lamp 1001 has a light emitter 1002 at the focus of a reflector 1003. A magnetron 1004 provides microwaves to a matching circuit 1005, from which the microwaves propagate along an antenna 1006 for exciting the light emitter.

The emitter as such has a central cavity 1011 in which is arranged a bulb 1012 having a void 1013 containing a microwave excitable material 1014. Typically the bulb is of transparent quartz. The cavity is surrounded by plane back and front walls 1015, 1016 and a circular cylindrical side wall 1017. The walls are sealed together, whereby the central cavity is sealed—typically with a vacuum maintained in it. In the embodiment shown, the bulb is integral with the front wall 1016 and extends towards the back wall with an insulating gap 1018 established at the distal/back end 1019 of the bulb.

The back, front and side walls define an enclosure 1020 for the cavity and are also formed of transparent quartz, whereby not only do they maintain the sealed nature of the cavity 1011, but they allow emission of light from the bulb, as explained in more detail below.

The cylindrical side wall extends back from the rear wall as a skirt 1021, defining with the back wall a recess 1022. In the recess is received—with a conventional engineering sliding as opposed to interference fit—a circular cylindrical, opaque body 1023 of alumina, which is a material of higher dielectric constant than quartz, typically 9.6 to 3.75. Centrally this has an antenna bore 10231 in which the antenna 1006 extends. The latter has a button head 1024, accommodated in a complementary recess 1025 in a front face 1026 of the body, the face being in abutment with the back wall 1015 of the enclosure. This arrangement places the high electric field present at the button in close proximity with the bulb and the excitable material in it.

A Faraday cage 1027 surrounds the enclosure, including the skirt 1021, extending back as far as a grounded, aluminium boss 1028 on which the light emitter is mounted, being held onto the boss by means of the cage and screws

1029 holding the cage to the boss. Thus the cage is grounded. The cage is reticular, that is netlike with apertures, in region of the cavity 1011 and plain further back to the boss 1028.

In use, microwaves are applied to the antenna and radiated into the enclosure from the antenna's button head 1024. Not only do they propagate to the bulb, but the enclosure together with the body, taking account of the dielectric constants of their materials, form a resonant system within the Faraday cage, as a result of which the microwaves propagated from the antenna build up a resonant electric field in the light emitter. The resultant electric field at the void in the bulb is much greater than it would be in the absence of the components being dimensioned for resonance. The field establishes a plasma in the excitable material in the void and light emitted therefrom radiates through the front and side walls. Nothing, except the bulb, extends into the cavity whereby no shadow is cast—as might be if the antenna extended into the cavity—except for any shadow from the Faraday cage. However its mesh is so small as not to cast a perceptible shadow.

Figure 13:
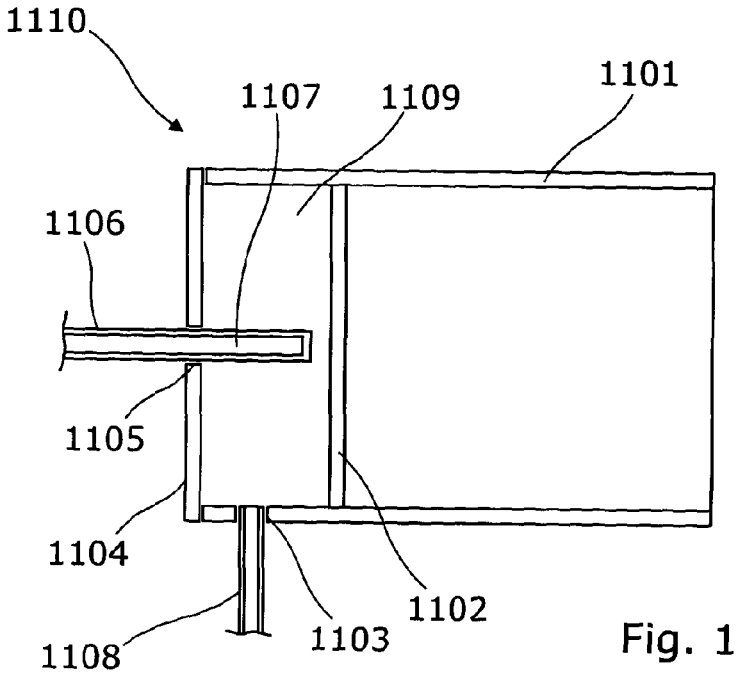
FIG. 13 is a side view on a larger scale again of components of the enclosure of the light emitter of FIG. 11.
Figure 14:
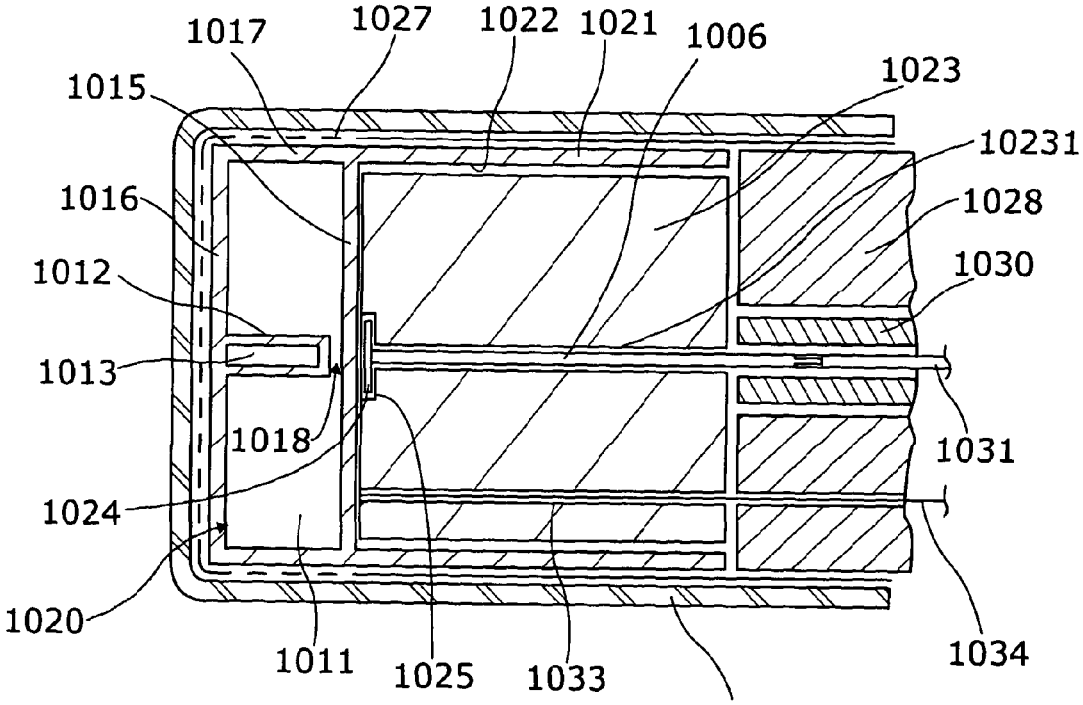
FIG. 14 is a cross-sectional side view of the enclosure of FIG. 12 assembled with a body of dielectric material, a button head antenna, a Faraday cage and UV screen.

Turning now to FIGS. 13 & 14, the enclosure is made as follows:

1. A length 1101 of quartz tube for the side wall and skirt is cut together with a flat, circular disc 1102 for the back wall. These are mounted in a glass lathe on mandrels with the disc perpendicular to the axis of the tube. The disc is fused into position.
2. A bore 1103 is made in the tube at the position of the enclosure.
3. A second quartz disc 1104 is cut for the front wall, being slightly larger than the first to abut the end of the length 1101. A central bore 1105 is drilled in it. A piece of small-diameter, closed-off, quartz tube 1106 is inserted in the bore 1105 and fused into position.
4. The tube 1106 is evacuated, filled with the excitable fill and sealed close to the surface of the disc 1104 to form a bulb 1107.
5. The disc 1104 is offered up to the end of the tube 1101 and fused to it.
6. A second piece 1108 of small diameter quartz tube is sealed into the bore 1103. The cavity 1109 in the enclosure 1110 formed is evacuated and the tube 1108 is "tipped off" at the bore 1103.

For operation at 2.450 Hz, the tube 1101 is 28.7 mm long and has a 38 mm outside diameter and 2 mm wall thickness. The discs are of 2 mm plate, the disc 1102 being a sliding fit in the tube 1101 and the disc 1104 being of 38 mm diameter. The disc 1102 is fused 9 mm from the open end of the tube 1101. The bulb forming tube is set to extend 8 mm from the disc 1104, giving an assembled clearance of 1 mm from the plate 1102. This tube is 6 mm in diameter with a 1.5 mm wall thickness.

Thus are formed the:

central cavity 1011
bulb 1012
void 1013
back and front walls 1015, 1016
circular cylindrical side wall 1017
insulating gap 1018
enclosure 1020
skirt 1021
recess 1022.

With the resultant dimensions and the alumina body 1023 completely filling the recess 1022 within the skirt 1021 and the Faraday cage 1027 closely surrounding the emitter, resonance at 2.45 GHz is possible.

The dimensions of the antenna and its button head 1024 are important for maximum energy transfer into the resonant system. The aerial is of brass and 2 mm in diameter, with the button being 6 mm in diameter and 0.5 mm in thickness. The aerial extends into the boss 1028, where within an insulating sleeve 1030 of alumina, it is to threaded into a connection 1031 from the matching circuit 1005, Surrounding the enclosure 1020 and the skirt 1021, outside the Faraday cage 1027 extends a borosilicate glass cover 1032. This provides physical protection for the cage and the quartz enclosure and skirt. Also it filters and protects against any small amount of UV emission from the plasma—the Faraday cage protecting against microwave emission. A final detail of note is a bore 1033 through the alumina body 1023 for an optic fibre 1034 for detecting establishment of the plasma, where the microwave power for continued light emission can be controlled.

As can be appreciated from FIG. 11, the light emitter 1002 has advantage in that the majority of light emitted by the plasma is able to be collected and focused by the reflector 1003. In particular the antenna is within the opaque body and does not shade any part of the light. It should also be noted that the bulb is surrounded by the vacuum in the enclosure 1020, whereby little heat is able to be conducted away from it and none is convected away. Thus the bulb is able to run hot. This is of advantage in the energy that might otherwise be dissipated as heat is available to maintain the high temperature of the plasma and the efficient emission of light.

The invention is not intended to be restricted to the details of the above described embodiments. For instance, the Faraday cage has been described as being reticular where lucent and imperforate around the alumina block and aluminium chassis block. It is formed from 0.12 mm sheet metal. Alternatively, it could be formed of wire mesh. Again the cage can be formed of an indium tin oxide deposit on the fabrication, suitably with a sheet metal cylinder surrounding the alumina and aluminium cylinders. Again where the fabrication and the alumina block are mounted on an aluminium chassis block, no light can leave via the alumina block. Where the alumina block is replaced with quartz, light can pass through this but not through the aluminium block. The block electrically closes the Faraday cage. The imperforate part of the cage can extend back as far as the aluminium block. Indeed the cage can extend onto the back of the quartz with the aluminium block being of reduced diameter.

Another possibility is that there might be an air gap between the fabrication and the alumina block, with the antenna crossing the air gap to abut the fabrication.

Whereas above, the fabrication is said to be of quartz and the higher dielectric constant body is said to be of alumina; the fabrication could be of other lucent material such as polycrystalline alumina and the higher dielectric material body could also be of other ceramic material.

As regards frequency of operation, all the dimensional details above are for an operating frequency of 2.45 GHz. It is anticipated that since this LUWPL of the invention can be more compact at any specific operating frequency than an equivalent LER LUWPL, the LUWPLs of this invention will find application at lower frequencies such as 434 MHz (still within the generally accepted definition of the microwave range), due balance between greater size due to the longer wavelength of electromagnetic waves and reduced LUWPL size resulting from the invention. For 434 MHz frequency, a solid-state oscillator is expected to be feasible in place of a magnetron, such as is used in productions LUWPLs operating at 2.45 GHz. Such oscillators are expected to be more economic to produce and/or operate.

In all the above embodiments, the fabrication is asymmetric with respect to its central longitudinal axis, particularly due to its normally provided skirt. Nevertheless, it can be anticipated the fabrication could have such symmetry. For instance, the embodiment FIG. 10 would be substantially symmetric if the front seal were finished flush and it did not have a skirt.

Further, the above fabrications are positioned asymmetrically in the waveguide space. Not only is this because the fabrications are not arranged with the inter-region abutment plane P coincident with the semi-volume plane V, but also because the fabrication is towards one end of the waveguide space; whereas the separate solid dielectric material body is towards the other end. Nevertheless, it can be envisaged that the separate body could be united into the fabrication where it is of the same material. In this arrangement, the fabrication is not positioned asymmetrically in the waveguide space. Nevertheless it is asymmetric in itself, with a cavity at one end and being substantially voidless at the other to provided different end to end volume average of its dielectric constant.

Another possible variant is the provision of a forwards extending skirt on the aluminium carrier block. This can be provided with a skirt on the fabrication or not. With it, the Faraday cage can extend back outside the carrier block skirt and be secured to it. Alternatively, where the cage is a deposit on the fabrication, the carrier block skirted can be urged radially inwards onto the deposited cage material for contact with it.

The invention claimed is:

1. A Lucent Waveguide Electromagnetic Wave Plasma Light Source comprising:

a fabrication of solid-dielectric, lucent material, the fabrication providing at least:

a closed void containing electromagnetic wave excitable plasma material;

a Faraday cage:

enclosing:

the fabrication or the fabrication except for a portion thereof enclosing a part of the closed void which extends through the Faraday cage to be partially without the cage and the second region as defined hereinbelow, being at least partially lucent, for light emission from it and delimiting a waveguide, the waveguide having:

a waveguide space, the fabrication occupying at least part of the waveguide space; and at least partially inductive coupling means for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

the arrangement being such that there is:

a first region of the waveguide space extending between opposite sides of the Faraday cage at this region, this first region:

accommodating the inductive coupling means and having a relatively high volume average dielectric constant and a second region of the waveguide space extending between opposite sides of the Faraday cage at this region, this second region:

having a relatively low volume average dielectric constant and being occupied by:

the fabrication of solid-dielectric, lucent material and either the closed void containing electromagnetic wave excitable plasma material alone or the closed void containing electromagnetic wave excitable plasma material and a cavity within the fabrication or the closed void containing electromagnetic wave excitable plasma material and an empty portion of the waveguide space between the fabrication and the Faraday cage or the closed void containing electromagnetic wave excitable plasma material and both a cavity within the fabrication and an empty portion of the waveguide space between the fabrication and the Faraday cage, the arrangement being such that the fabrication's lucent material permits light from the plasma material in the void to be emitted via the at least partially lucent Faraday cage.

2. A LUWPL according to claim 1, wherein the second region extends beyond the void in a direction from the inductive coupling means past the void.

3. A LUWPL according to claim 1, wherein the fabrication has at least one cavity distinct from the plasma material void, and the cavity extends between an enclosure of the void and at least one peripheral wall in the fabrication, the peripheral wall having a thickness less than the extent of the cavity from the enclosure to the peripheral wall.

4. A LUWPL according to claim 1, wherein:

the fabrication has at least one external dimension which is smaller than the respective dimension of the Faraday cage, the extent of the portion of the waveguide space between the fabrication and the Faraday cage being empty of solid dielectric material or the fabrication is arranged in the Faraday cage spaced from an end of the waveguide space opposite from its end at which the inductive coupler is arranged.

5. A LUWPL according to claim 1, wherein the solid dielectric material surrounding the inductive coupling means is of:

the same material as that of the fabrication or of a material of a higher dielectric constant than that of the fabrication's material, the higher dielectric constant material being in a body surrounding the inductive coupling means and arranged adjacent to the fabrication.

6. A LUWPL according to claim 1, wherein the Faraday cage is lucent:

for light radiation radially thereof and for light radiation forwardly thereof, that is away from the first, relatively high dielectric constant region of the waveguide space.

7. A LUWPL according to claim 1, wherein the inductive coupling means is or includes an elongate antenna and the antenna is a plain wire extending in a bore in the body of relatively high dielectric constant material and the bore is a through bore in the said body with the antenna abutting the fabrication and a counterbore is provided in the front face of the separate body abutting the rear face of the fabrication and the antenna is T-shaped (in profile) with its T head occupying the counterbore and abutting the fabrication.

8. A Lucent Waveguide Electromagnetic Wave Plasma Light Source comprising:

a fabrication of solid-dielectric, lucent material, the fabrication providing at least:

an enclosure of a closed void containing electromagnetic wave excitable plasma material;

a Faraday cage:

enclosing:

the fabrication or the fabrication except for a portion thereof enclosing a part of the closed void which extends through the Faraday cage to be partially without the cage and the second region as defined hereinbelow, the fabrication, being at least partially lucent, for light emission from it and delimiting a waveguide, the waveguide having:

a waveguide space, the fabrication occupying at least part of the waveguide space and the waveguide space having an axis of symmetry; and at least partially inductive coupling means for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

wherein:

the arrangement is such that with the waveguide space notionally divided into equal front and rear semi-volumes:

the front semi-volume is:

at least partially occupied by the said fabrication with the said void in the front semi-volume and is enclosed at least on opposite sides (but not between the front and rear semi-volumes) by a front, lucent portion of the Faraday cage via which a portion of the light from the void can radiate, the rear semi-volume has the inductive coupler extending in it and the volume average of the dielectric constant of the content of the front semi-volume is less than that of the rear semi-volume.

9. A LUWPL according to claim 8, wherein the difference in front and rear semi-volume volume average of dielectric constant is caused by the said fabrication having end-to-end asymmetry and/or being asymmetrically positioned in the Faraday cage, and:

wherein:

the said fabrication occupies the entire waveguide space, at least one evacuated or gas-filled cavity is included in the fabrication within the front semi-volume, thereby providing the lower volume average of dielectric constant of the front semi-volume, and the cavity extends between the enclosure of the void and at least one peripheral wall in the fabrication, the peripheral wall having a thickness less than the extent of the cavity from the enclosure of the void to the peripheral wall or wherein:

the said fabrication occupies a front part of the waveguide space, a separate body of the same material occupies the rest of the waveguide space and at least one evacuated or gas-filled cavity is included in the fabrication within the front semi-volume, thereby providing the lower volume average of dielectric constant of the front semi-volume, and the cavity extends between the enclosure void and at least one peripheral wall in the fabrication, the peripheral wall having a thickness less than the extent of the cavity from the enclosure of the void to the peripheral wall or wherein:

the said fabrication occupies a front part of the entire waveguide space and a separate body of higher dielectric constant material occupies the rest or at least the majority of the waveguide space and:

at least one evacuated or gas-filled cavity is included in the fabrication within the front semi-volume, thereby enhancing the difference in the dielectric-constant, volume averages between the front and rear semi-volumes, and the cavity extends between the enclosure of the void and at least one peripheral wall in the fabrication, the peripheral wall having a thickness less than the extent of the cavity from the enclosure of the void to the peripheral wall.

10. A LUWPL according to claim 9, wherein the or each cavity is:

evacuated and/or gettered and/or occupied by a gas at low pressure of the order of one half to one tenth of an atmosphere.

11. A LUWPL according to claim 8, wherein the enclosure void extends laterally of the cavity, crossing a central axis of the fabrication and/or the enclosure of the void extends on the central longitudinal, i.e. front to rear, axis of the fabrication and the enclosure of the void is connected to both a rear wall and a front wall of the fabrication or the enclosure of the void is connected to the front wall only of the fabrication.

12. A LUWPL according to claim 11, wherein the enclosure of the void extends through the front wall and partially through the Faraday cage and wherein:

the front wall is domed or the front wall is flat and parallel to a rear wall of the fabrication.

13. A LUWPL according to claim 8, wherein:

the enclosure of the void and the rest of the fabrication are of the same lucent material or the enclosure of the void and at least outer walls of the fabrication are of the differing lucent material and the outer wall(s) are of ultraviolet opaque material.

14. A LUWPL according to claim 8, wherein the part of the waveguide space occupied by the fabrication substantially equates to the front semi-volume.

15. A LUWPL according to claim 8, wherein:

the separate body abuts against a rear face of the fabrication and is located laterally by the Faraday cage or the separate body is spaced by an air gap from a rear face of the fabrication and is located laterally by the Faraday cage or the fabrication has a skirt with the separate body both abutting a rear face of the fabrication and being located laterally within the skirt.

16. A LUWPL according to claim 8, wherein the void enclosure is tubular and:

the fabrication and the separate body of solid dielectric material, where provided, are bodies of rotation about a central longitudinal axis.

17. A LUWPL according to claim 8 in combination with
a electromagnetic wave circuit having:
an input for electromagnetic wave energy from a source thereof and
an output connection thereof to the inductive coupling means of the LUWPL;
wherein the electromagnetic wave circuit is
a complex impedance circuit configured as a bandpass filter and matching output impedance of the source of electromagnetic wave energy to the inductive input impedance of the LUWPL, comprising:
a metallic housing,
a pair of perfect electric conductors (PECs), each grounded inside the housing,
a pair of connections connected to the PECs, one for input and the other for output and
a respective tuning element provided in the housing opposite the distal end of each PEC and:
the electromagnetic wave circuit is a tunable comb line filter and there is included:
a further tuning element provided in the iris between the PECs.

18. A LUWPL according to claim 9, wherein:
the fabrication is of quartz,
the body is of alumina and
the alumina body together fill the waveguide space.

19. A Lucent Waveguide Electromagnetic Wave Plasma Light Source comprising:
a fabrication of solid-dielectric, lucent material, the fabrication providing at least:
a closed void containing electromagnetic wave excitable plasma material;
a Faraday cage:
enclosing:
the fabrication or
the fabrication except for a portion thereof enclosing a part of the closed void which extends through the Faraday cage to be partially without the cage and the second region as defined hereinbelow,
being at least partially lucent, for light emission from it and
delimiting a waveguide, the waveguide having:
a waveguide space, the fabrication occupying at least part of the waveguide space; and
at least partially inductive coupling means for introducing plasma exciting electromagnetic waves into the waveguide at a position at least substantially surrounded by solid dielectric material;
whereby on introduction of electromagnetic waves of a determined frequency a plasma is established in the void and light is emitted via the Faraday cage;
wherein:
the volume average of the dielectric constant of the fabrication is less that the dielectric constant of its material.

20. A Lucent Waveguide Electromagnetic Wave Plasma Light Source comprising:
a fabrication of solid-dielectric, lucent material, the fabrication providing at least:
a closed void containing electromagnetic wave excitable plasma material;
a Faraday cage:
enclosing:
the fabrication or
the fabrication except for a portion thereof enclosing a part of the closed void which extends through the Faraday cage to be partially without the cage and the second region as defined hereinbelow,
being at least partially lucent, for light emission from it and
delimiting a waveguide, the waveguide having:
a waveguide space, the fabrication occupying at least part of the waveguide space; and
at least partially inductive coupling means for introducing plasma exciting electromagnetic waves into the waveguide at a position at least substantially surrounded by solid dielectric material;
a body of solid dielectric material in the waveguide space, the body abutting the fabrication and having the inductive coupling means extending in it,
whereby on introduction of electromagnetic waves of a determined frequency a plasma is established in the void and light is emitted via the Faraday cage.

21. A LUWPL according to claim 20, wherein the inductive coupling means extends as far as the abuttal interface between the body and the fabrication and
the fabrication and the body are of the same material or
the fabrication and the body are of differing materials, the body having a higher dielectric constant.

* * * * *